US009867416B2

(12) United States Patent
Woolf

(10) Patent No.: US 9,867,416 B2
(45) Date of Patent: Jan. 16, 2018

(54) COLLAPSIBLE HELMET

(71) Applicant: Jeffrey Moss Woolf, London (GB)

(72) Inventor: Jeffrey Moss Woolf, London (GB)

( * ) Notice: Subject to any disclaimer, the term of this patent is extended or adjusted under 35 U.S.C. 154(b) by 0 days.

(21) Appl. No.: 15/679,973

(22) Filed: Aug. 17, 2017

(65) Prior Publication Data

US 2017/0340047 A1 Nov. 30, 2017

Related U.S. Application Data

(63) Continuation of application No. 13/878,967, filed as application No. PCT/GB2011/001481 on Oct. 13, 2011, now Pat. No. 9,743,704.

(30) Foreign Application Priority Data

Oct. 13, 2010 (GB) ..... 1017305.2
May 4, 2011 (GB) ..... 1107373.1

(51) Int. Cl.
*A42B 3/32* (2006.01)

(52) U.S. Cl.
CPC ..... *A42B 3/322* (2013.01)

(58) Field of Classification Search
CPC ..... A42B 3/322; A42B 3/201; A42B 3/32
See application file for complete search history.

(56) References Cited

U.S. PATENT DOCUMENTS 5,173,970 A * 12/1992 Shifrin ..... A42B 1/08 2/209.12
2008/0022441 A1* 1/2008 Oranchak ..... A42B 1/242 2/410

* cited by examiner

*Primary Examiner* — Richale Quinn
(74) *Attorney, Agent, or Firm* — Edwin D. Schindler

(57) ABSTRACT

A collapsible helmet including a shell having two or more components which are hingedly connected together about fold lines extending across the shell. Each component includes a plurality of panels with each panel being hingedly connected to at least one adjacent panel. The shell may be adjustable between a first configuration in which the helmet may be placed over the head of the user and a second configuration in which the components are flattened and are arranged in a substantially overlying relationship.

12 Claims, 2 Drawing Sheets

COLLAPSIBLE HELMET

CROSS-REFERENCE TO PRIOR APPLICATIONS

This is a continuation of U.S. patent application Ser. No. 13/878,967, filed Apr. 11, 2013, which represents the United States National Phase patent application of P.C.T. International Application No. PCT/GB2011/001481, filed Oct. 13, 2011, now U.S. Pat. No. 9,743,704.

FIELD OF THE INVENTION

This invention relates to collapsible helmets which may be used by, for instance, cyclists, motorcyclists, participants in various sporting activities and those people operating in workplaces where protective headgear is worn.

BACKGROUND TO THE INVENTION

Protective helmets for outdoor activities such as cycling are generally hemispherical in shape, conforming approximately to the shape of the top of the head, and are made of rigid, thick, impact absorbing materials designed to protect the head from being damaged if the user falls against a hard surface, including a protrusion such as a kerb stone, or if hit by a falling object such as may be encountered on a building site, quarry or mine. There are a specific rigorous safety standards required for different sporting activities. Helmets which meet these standards are typically bulky and awkward to store or put in a bag etc when not being worn.

STATEMENTS OF THE INVENTION

According to the present invention, there is provided a helmet comprising a shell having two or more components which are hingedly connected together about fold lines extending across the shell, each component comprising a plurality of panels, each panel being hingedly connected to at least one adjacent panel, whereby the shell may be adjustable between a first configuration in which the shell may be placed over the head of a user and a second configuration in which said first and second components are each flattened and are arranged in a substantially overlying relationship.

Preferably, the shell has two of said components, and the fold line preferably extends longitudinally of the helmet.

Preferably, each panel has at least one edge which is non-linear and which abuts a corresponding non-linear edge on an adjacent panel.

Preferably, the inside of the shell is provided with integral inwardly projecting ribs, the ribs of the components being positioned so that, when the helmet is in its relatively collapsed condition, at least some of the ribs of the one component are interleaved with ribs of a second component. This arrangement will ensure that maximum thickness of protection can be combined with minimal thickness when in the second configuration.

Preferably, the helmet is provided with means for securing the first and second components together so that the shell is locked into its first configuration, and has a rigid structure.

Preferably, the components are connected together by means of a living hinge, that is to say, a thin flexible hinge made from a suitable flexible material such as a plastic material which is able to bend along the line of the hinge.

Preferably, each panel is hingedly connected to an adjacent panel by means of a living hinge.

Preferably the living hinges between the panels and/or between the components are formed from a single sheet of material, more preferably a single sheet of plastics material.

More preferably, the single sheet of material is imbedded within the panels.

Preferably, each panel is internally shaped to conform approximately to that curved area of the user's head which, when the helmet is in use, lies adjacent to said panel.

Preferably, the helmet is provided with front and rear pieces, each piece comprising two hingedly connected together elements which are movable between an open and a closed position.

Preferably, means are provided to urge said elements into the open position, more preferably, said urging means are magnetic.

Preferably means are provided to urge the shell components towards each other. More preferably, said urging means are magnetic.

The present invention further provides a shell for a helmet of the invention.

The present invention also provides a method of providing protection to a person's head, the method comprising providing a helmet of the invention in its collapsed condition, opening up the helmet into its open condition and securing the helmet on the person's head.

In addition, the present invention provides a method for storing or carrying a helmet of the invention after use, the method comprising removing the helmet from the user's head and causing the helmet to assume its collapsed condition.

The present invention may enable a helmet to be collapsed down to about one third of its volume for carrying or storage purposes.

Hemispherical shapes, such as those of a protective helmet, are strong and do not naturally collapse or fold. However, the invention makes use of the foldability of other three dimensional shapes, such as some open based polyhedrons, having hinge axes along the edges and having ridged faces. In this way complex un-foldable polyhedrons can fold by splitting between faces along selected edges.

The invention in effect adds protective cladding into the inside and outside faces of foldable polyhedron to form a generally hemispherical helmet shape. Simple polyhedrons with curved cladding do not fold very flat. More complex polyhedrons can achieve the balance between the minimum number of folds and the flatness of the fold, especially if the inner surfaces have offset ribs.

According to the present invention, with suitable locking clips around the rim to make the helmet into an unfoldable polyhedron, thereby forming a rigid hemisphere when in use, the shell then behaves in a similar way to that of a conventional helmet. However, with the clips released it can be collapsed or folded.

DETAILED DESCRIPTION OF THE INVENTION

Figure 2:
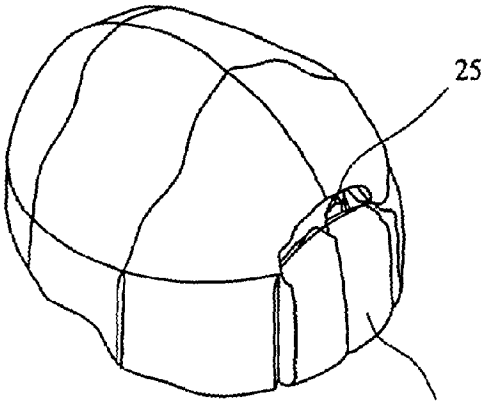
FIG. 2 is a rear perspective view of the helmet shell of FIG. 1.

The present invention will now be described, by way of example only, with reference to the accompanying drawings.

Referring to the accompanying drawings a helmet of the present invention includes a helmet shell 1 and connectors such as straps (not shown) for securing the helmet to the head of a user. Shell 1 comprises a plurality of rigid foam panels 3 mounted on a polypropylene sheet in the form of a frame 5 which is a single sheet extending over substantially the entirety of shell 1 and which is provided as a series of living hinges 7 allowing panels 3 to pivot relative to each other.

Each panel 3 has at least one non-linear edge 4 which matches and abuts a corresponding edge of an adjacent panel. As a result, protection is provided even where the helmet encounters a sharp edge, such as that of a kerb stone, which would otherwise penetrate the shell through to the skull of the wearer.

Figure 3:
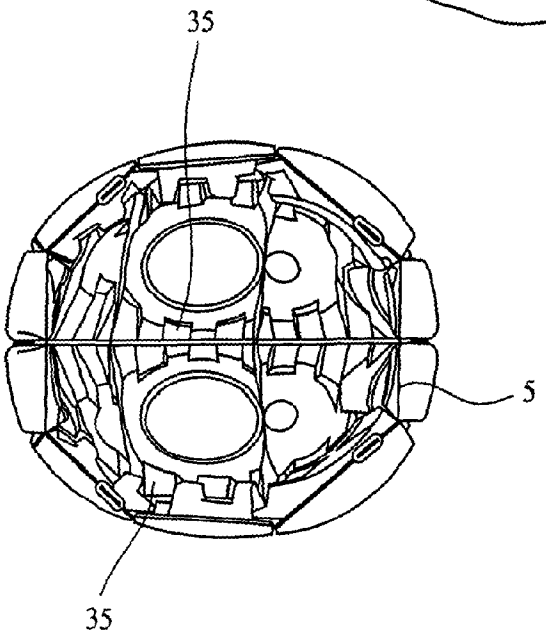
FIG. 3 is a bottom plan view of the helmet shell of FIG. 1.
Figure 1:
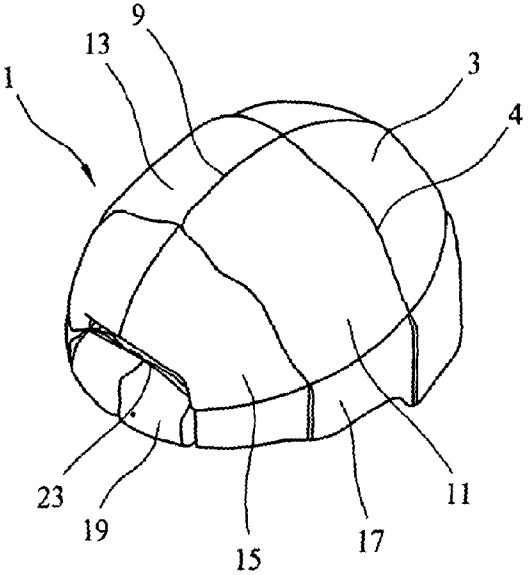
FIG. 1 is a perspective front view showing the shell of a helmet in accordance to the present invention.
Figure 4:
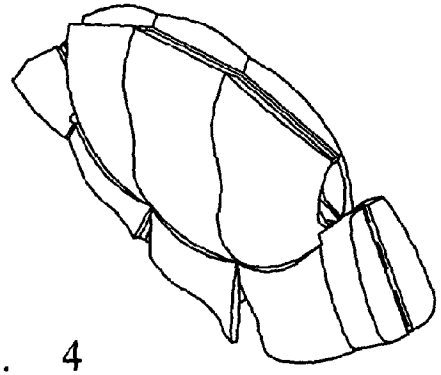
FIG. 4 is a side perspective view of the helmet shell of FIG. 1 in its collapsed condition.
Figure 6:
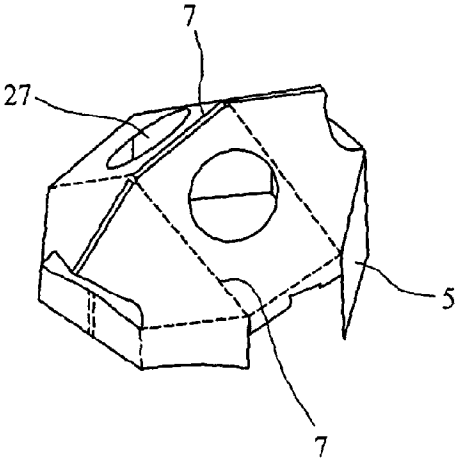
FIG. 6 is a front perspective view of the frame of the helmet shell of FIG. 1.

Accordingly, a helmet incorporating a shell 1 is capable of assuming two configurations. In its open condition, as illustrated in FIGS. 1-3, it may be worn by a user in order to protect his head. In its closed or collapsed condition, as illustrated in FIG. 4, the helmet is relatively flat, occupying about one third of the volume occupied in its open condition, making for convenient storage in a briefcase or other bag or providing a relatively non-bulky article for carrying around by hand.

Shell 1 is collapsible about axis or fold line 9 which extends centrally from front to rear. In another embodiment, the corresponding fold line may extend transversely from side to side or there may be two or more such fold lines extending across the shell. Shell 1 comprises two portions 11 and 13 which are largely identical, subject to the offset rib feature described below, and each provides in effect a half portion of the shell.

Each half shell comprises top panels 15, side panels 17, front panels 19 and rear panels 21. Provided between front panels 19 and adjacent top panels 15 is a front vent passage 23. A corresponding rear vent passage 25 is provided between rear panels 21 and top panels 15. As indicated above, the entire assembly of panels is mounted on the polypropylene frame 5 with the latter imbedded within upper and lower panel sections. Frame 7 may be provided with holes 27 through which the foam material of the panels extends.

The panels 3 are in general internally shaped to fit the area of the wearer's head which, in use, will lie adjacent to the panel. Each panel 3 is very broadly of trapezoidal shape in plan. In other embodiments, the panels may be of other shapes, such as oval.

Magnets are provided on the meeting edges of front panels 19 and rear panels 21 so that adjacent panels are attracted to each other and support the shell in its open position. Magnets are also provided on opposed panels 11 and 13 and these attract each other to maintain the integrity of the shell in its collapsed condition.

Figure 5:
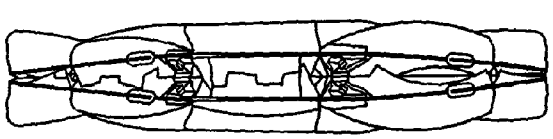
FIG. 5 is a bottom plan view of the helmet shell of FIG. 1 in its collapsed condition.
Figure 7:
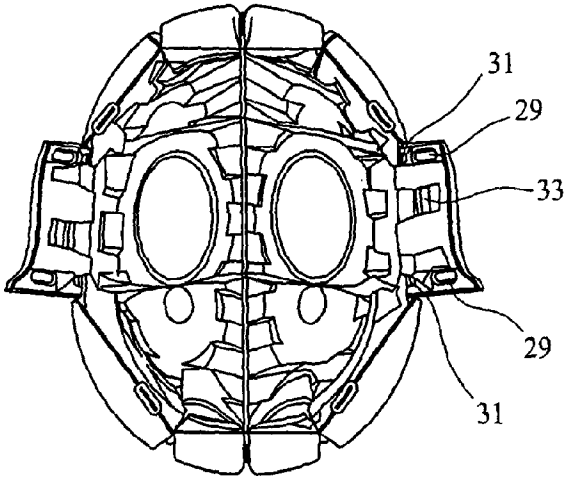
FIG. 7 is a bottom plan view of the helmet shell of FIG. 1 with side segments in their released positions.

Referring in particular to FIG. 7, the central panel of each of side panels 17 is connected to adjacent side panels by means of a locking mechanism. This locking mechanism includes bosses 29 on the central panels and catches 31 located on the adjacent panels. A slide release button 33 is located on the central panel 17 which is operable to disengage the catches and bosses. This locking mechanism is such that when the shell is opened the central panel 17 can be moved from the position shown in FIG. 7 to that in FIG. 1 with the locking mechanism snapping into place. Release of the locking mechanism by release buttons 33 allows the panels 17 to be moved outwardly and the shell to be folded to the position shown in FIG. 5.

The interior of the shell 1 is profiled to provide ribs such as ribs 35. The ribs of 1 component of shell 1 are offset from the ribs of the corresponding component on the other side of shell 1. They are arranged such that when the helmet is collapsed these ribs interleave. Accordingly a strong construction can be provided to the helmet while allowing the helmet to collapse to a very flat structure.

The invention claimed is:

1. A helmet comprising a shell having two or more components which are hingedly connected together about fold lines extending across the shell, each component comprising a plurality of panels with the components of the shell being provided with integral, inwardly projecting ribs, the ribs of the components being positioned so that, when the helmet is in its relatively collapsed condition, at least some of the ribs of a first component are interleaved with ribs of a second component, each panel being hingedly connected to at least one adjacent panel, wherein the shell is adjustable between a first configuration in which the shell is able to be placed over the head of the user and a second configuration in which said first component and said second component are each flattened and are arranged in a substantially overlying relationship, wherein means are provided for securing the first component and the second components together so that the shell is locked into its first configuration.

2. The helmet according to claim 1, wherein the shell has two of said components and the fold line extends longitudinally of the helmet.

3. The helmet according to claim 1, wherein each panel has at least one edge which is non-linear and which abuts a corresponding non-linear edge of an adjacent panel.

4. The helmet according to claim 1, wherein the components are connected together via a living hinge.

5. The helmet according to claim 1, wherein each panel is hingedly connected to an adjacent panel by means of a living hinge.

6. The helmet according to claim 5, wherein the living hinges between the panels, or between the components, are formed from a single sheet of material.

7. The helmet according to claim 1, wherein each panel is internally shaped to conform approximately to that curved area of the user's head which, when the helmet is in use, lies adjacent to said panel.

8. The helmet according to claim 1, wherein the helmet is provided with front and rear pieces, each of said front and rear pieces comprising two hingedly connected together elements which are movable between an open position and a closed position.

9. The helmet according to claim 8, further comprising means for urging said elements into the open position.

10. The helmet according to claim 9, wherein said means for urging is magnetic.

11. The helmet according to claim 1, wherein further comprising means for urging said first component and said second component toward each other.

12. The helmet according to claim 11, wherein said means for urging said first component and said second component toward each other is magnetic.

* * * * *